US012060794B2

(12) United States Patent
Seutter

(10) Patent No.: US 12,060,794 B2
(45) Date of Patent: Aug. 13, 2024

(54) MULTI-ACTIVATION REAMER WITH ACTIVATION CONFIRMATION

(71) Applicant: Halliburton Energy Services, Inc., Houston, TX (US)

(72) Inventor: Daniel Seutter, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 97 days.

(21) Appl. No.: 17/886,062

(22) Filed: Aug. 11, 2022

(65) Prior Publication Data

US 2024/0052706 A1 Feb. 15, 2024

(51) Int. Cl.
*E21B 7/28* (2006.01)
*E21B 10/32* (2006.01)

(52) U.S. Cl.
CPC ..... *E21B 7/28* (2013.01); *E21B 10/32* (2013.01)

(58) Field of Classification Search
CPC ..... E21B 7/28; E21B 10/32; E21B 10/26
See application file for complete search history.

(56) References Cited

U.S. PATENT DOCUMENTS

2010/0089583 A1* 4/2010 Xu ..... E21B 47/13 175/57
2014/0332270 A1* 11/2014 Odell ..... E21B 41/00 175/406
2019/0003260 A1* 1/2019 Odell ..... E21B 47/14

OTHER PUBLICATIONS

Schlumberger—Rhino XM, on-demand multiactivated reamer, Complete and reliable control of reamer activation and deactivation, 2021.
Weatherford—Riptide Drilling Reamer, Maximizing hole-enlargement-while-drilling speed and reliability, 2004-2017.

* cited by examiner

*Primary Examiner* — Caroline N Butcher
(74) *Attorney, Agent, or Firm* — Michael Jenney; C. Tumey Law Group PLLC

(57) ABSTRACT

A multi-activation reamer optionally includes modular activation and pulse confirmation blocks for activating the reamer and confirming activation. A reamer activation signal may be communicated downhole, optionally using an activation sequence of drill string flow and rotation detectable by downhole sensors. An on-board controller receives the activation signal and opens an activation flow path in the activation block to hydraulically actuate the reamer arms. A pulse flow path is also opened in the pulse confirmation block, optionally using pressure from the activation flow path. Flow along the pulse flow path is modulated to generate a flow pattern detectable uphole of the reamer to confirm activation of the reamer.

19 Claims, 11 Drawing Sheets

MULTI-ACTIVATION REAMER WITH ACTIVATION CONFIRMATION

BACKGROUND

Wells are commonly drilled to recover hydrocarbons such as oil and gas from subterranean formations. Reamers are used to increase the wellbore size at various depth intervals in a wellbore. This increased wellbore size has various benefits such as enabling the installation of larger casing diameters or to increase the borehole surface area to enhance production of hydrocarbons. Various reamer activation methods have been utilized, such as ball drop, flow darts, differential pressure and flow rate changes. Some approaches limit the number of activations to a single event. Many of these activation designs restrict the through-bore size of the tool or even block the bore. Reamers that are capable of more than one activation (i.e., multiple activation) generally increase the length of the tool due to the mechanism utilized for the multiple activation.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
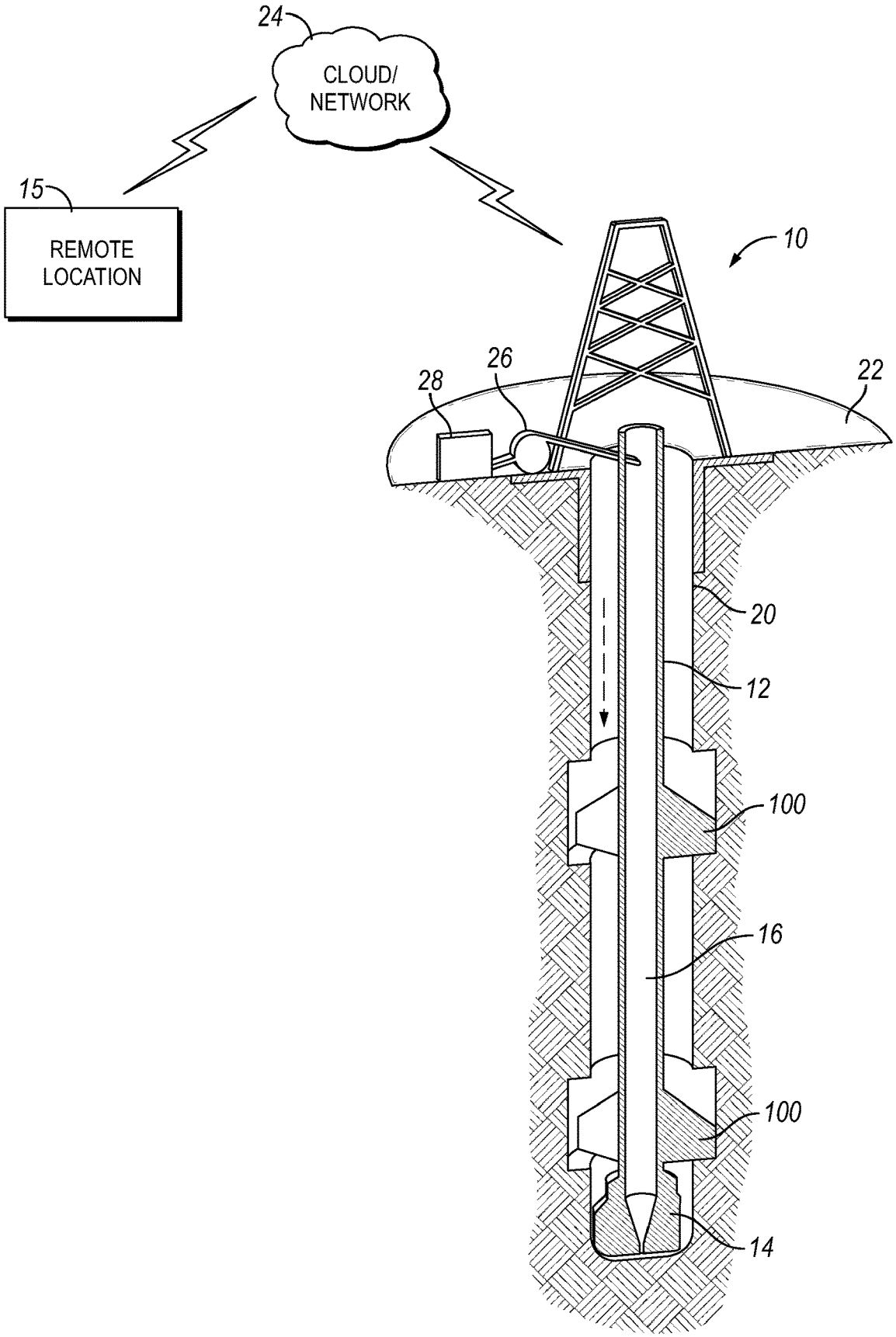
FIG. 1 is a schematic, elevation view of a well site 10 at which a well may be constructed.

A multi-activation reamer and method are disclosed that allow for reamer activation from the surface of a wellsite or even from a remote location. The reamer may be activated and re-activated any number of times, without having to drop a ball or other flow restrictor to induce a pressure increase, without increasing the length of the reamer tool, and without having to trip out of the wellbore to reset the reamer. A reamer activation signal can be communicated downhole without the need for a dedicated electrical, electromagnetic, or optical signal transmission pathway along the drill pipe. Instead, the reamer activation signal may be communicated downhole in the form of an activation sequence of flow through the drill string and/or rotation of the drill string that is detectable downhole, such as a combination of drill string pressure and rotation, that are sensed downhole and interpreted by an electronic controller on the reamer body.

In response to the reamer activation signal, flow of pressurized drilling fluid is opened along an activation flow path through the reamer to actuate the reamer arms. Flow is also opened along a pulse flow path, which flow may be modulated using a metering system to generate a flow pattern detectable uphole as confirmation of reamer activation. The confirmation of the reamer activation (or deactivation) may trigger one or more steps, such as to commence (or cease) reaming, or any other step related to reaming, drilling, or other wellbore activities that may or may not involve the use of the drill string. The activation flow path, pulse flow path, controller, metering system, and other reamer components may be embodied on modular block assemblies, such as an activation block and a pulse confirmation block.

In examples discussed below, a multi-activation mechanism may be integrated into a lower tubular section of the reamer. The multi-activation mechanism may be controlled with a low voltage electronic system that can initiate valve transitions during a "pumps off" condition activating the reamer. As flow is re-established, the adjusted porting activates the reamer cutting components with filtered drilling mud based on differential pressure. As the reamer is rotated through the desired depth interval, a larger bore hole diameter is achieved. The reamer is then deactivated and the arms are retracted. Two modular block assemblies that are mounted radially on the outer surface of the tubular control the routing of the filtered drilling fluid and subsequently control the deployment of the cutting arms. One block, which may be referred to as the activation block, provides an activation flow path for activating the reamer cutting components. The second block, which may be referred to as the pulse confirmation block, provides a damping flow path to create a time-controlled pressure transition indicating reamer activation. This pressure transition is large enough to be recognized on surface.

The block assemblies used in the reamer may both be oil-filled and pressure compensated for ensuring the longevity of the internal components such as seals. An additional benefit of the external block design is that the sub-assemblies can be assembled and oil filled in a clean environment. This modular design will also help to reduce the servicing time required for maintenance or turn-around procedures. These and other features and technical advantages are described below in association with example embodiments in the figures.

FIG. 1 is a schematic, elevation view of a well site 10 at which a well may be constructed. Aspects of constructing the well include drilling a wellbore 20 and selectively widening one or more portions of the wellbore 20 by reaming. The wellbore 20 may be drilled using a drill string 12 having a drill bit 14 at the lower end and one or more reamers 100 supported anywhere along the drill string 12 above the drill bit 14. This particular example shows two reamers 100 supported at different axial locations on the drill string 12 above the drill bit 14. The wellbore 20 may be drilled by rotating the entire drill string 12 from surface 22 and/or by rotating the drill bit 14 relative to the drill string 12, such as using a mud motor. The reamers 100 are typically deactivated during drilling and would rotate along with the drill string 12 without appreciably engaging the wellbore 20. A portion of the wellbore 20 may then be subsequently reamed by activating the reamers 100 and rotating the drill string 12 with reamer arms engaging a selected portion of the wellbore 20, as further discussed below. However, if desired, drilling and reaming could be performed simultaneously, such as by rotating the drill string with the reamers activated to extend the wellbore and simultaneously ream an existing portion of the wellbore uphole of the drill bit. A variety of drill string configurations and drill string modes of operation are known in the art including various uses of drill string rotation, mud motor rotation, and combinations thereof for achieving any of a variety of wellbore forming steps and features, any of which may incorporate aspects of this disclosure.

The drill string 12 may be progressively assembled over the course of drilling by adding any number of drill pipe segments or stands 16, the reamers 100, and other drill string components until the desired wellbore depth is reached. Because the reamers 100 in this example are included on the same drill string 12 used to drill the wellbore 20, the wellbore 20 may be drilled and reamed in a single trip. However, a reamer and method according to the disclosure may be used to ream an existing wellbore if desired.

While drilling or reaming, fluid may be circulated downhole to help lubricate the bit or reamer cutting structures and circulate the cuttings back to surface. Typically, the overall drilling fluid path would be down through the drill string 12 and up through an annulus 21 between the drill string 12 and the wellbore 20, as diagrammed. One or more surface pump 26 may be provided at the surface 22 to generate the pressurized flow. A filtration system 28 may be provided at surface to remove the bulk of cuttings and other contaminants from the fluid as it is circulated. As this fluid circulation equipment is generally available for drilling purposes, the fluid circulated downhole may be referred to herein as drilling fluid, even when not actively drilling or reaming. This pressurized drilling fluid may additionally be used as described below to activate the reamer(s) 100.

The reamers 100 are generally tripped into the wellbore 20 in a deactivated stated, e.g., with reamer arms retracted, as further discussed in relation to subsequent figures. The reamers 100 may be selectively activated (or alternately, deactivated) by generating a reamer activation (or deactivation) signal 18, which can be received and detected downhole at the reamers 100. The reamer activation signal 18 may be generated at a surface 22 of the wellsite 10, such as at an above-ground location where a human operator and/or control equipment may be located. The activation signal 18 according to this disclosure may comprise any form of a signal that may be communicated and detectable downhole for activating the reamer(s) 100 and distinguishable from other phenomena that are not intended as the activation signal.

The activation signal in at least some examples may comprise an electrical, electromagnetic, or optical signal. The electrical, electromagnetic, or optical signal may be used to at least initiate activation of the reamer(s) 100. In some cases the reamer activation signal could even be initiated at a remote location 15 and communicated to the wellsite 10 over any suitable communication network 24, e.g., a cloud, Internet, cellular, satellite network, etc., over any suitable transmission medium such as wireless, electromagnetic, fiber optic, and/or electrical transmission medium of any suitable type.

In certain well installations, electrical, electromagnetic, or optical signal pathways can sometimes be provided along the drill string 12, and may be used to communicate the activation signal 18 downhole to the reamer(s) 100 from the surface 22 of the well site. More commonly, however, such electrical, electromagnetic, or optical signal pathways are not available in a drill string. In those cases, the activation signal 18 may still comprise an electrical, electromagnetic, or optical signal to initiate the reamer activation, e.g., at surface 22 or the remote location 15, and the activation signal 18 may further comprise an activation sequence of physically measurable drill string parameters such as flow through and/or rotation of the drill string 12 that is detectable downhole, and unlikely to occur by accident or otherwise which does not indistinguishably resemble some other flow and/or rotational sequence that might occur during routine drill string operation when activation of the reamer is not intended. The activation sequence of flow and/or rotation may include absolute values and/or changes in the flow and/or changes in the rotation. Rotation may include, for example, rotation count, revolutions per minute (RPMs), stop/go patterns, or other detectable parameter related to rotation of the drill string 12. Flow may include, for example, volumetric rate of flow, pressure, or other flow parameter, either absolute values or changes in value. Such an activation sequence may be used to communicate from the surface 22 downhole to the reamer(s) 100 without the need for electrical, electromagnetic, or optical pathways running down the entire drill string 12. The activation sequence may be detected downhole, such as using flow, pressure, and RPM sensors and converted back to an electronic signal. The signal can be analyzed for detecting the predefined activation sequence.

Figure 2:
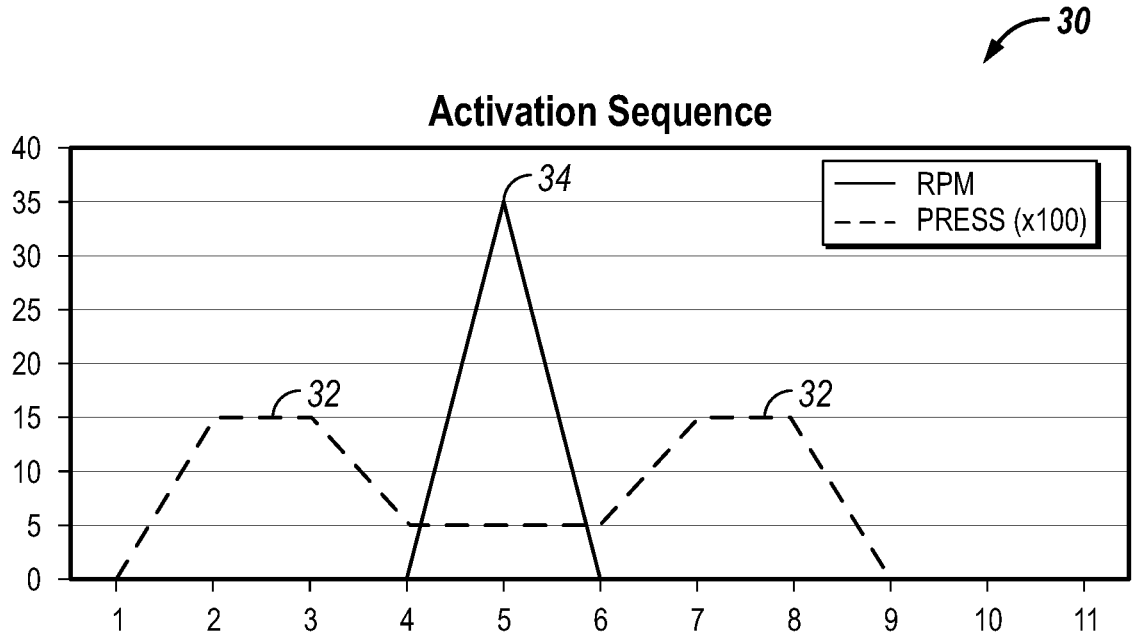
FIG. 2 is a graphical representation of an activation sequence 30 according to an example that combines an activation sequence of rotation and flow.

FIG. 2 is a graphical representation of an activation sequence 30 according to an example that combines an activation sequence of rotation and flow. The rotation may be expressed in terms of revolutions per minute (RPMs) of the drill string. The flow may be expressed in terms of a flow pressure of a drilling fluid through the drill string or along an annulus between the drill string and the wellbore. In this case, the activation signal is embodied as an activation sequence comprising two pressure rises 32 interspersed with an RPM spike 34. Sensors may be located downhole in a well, specifically in a reamer or a controller in communication with a reamer, for sensing the activation sequence 30. For example, a pressure sensor may be used to sense the pressure rises 32 and a velocity sensor may be used to sense the RPM spike 34.

Figure 3:
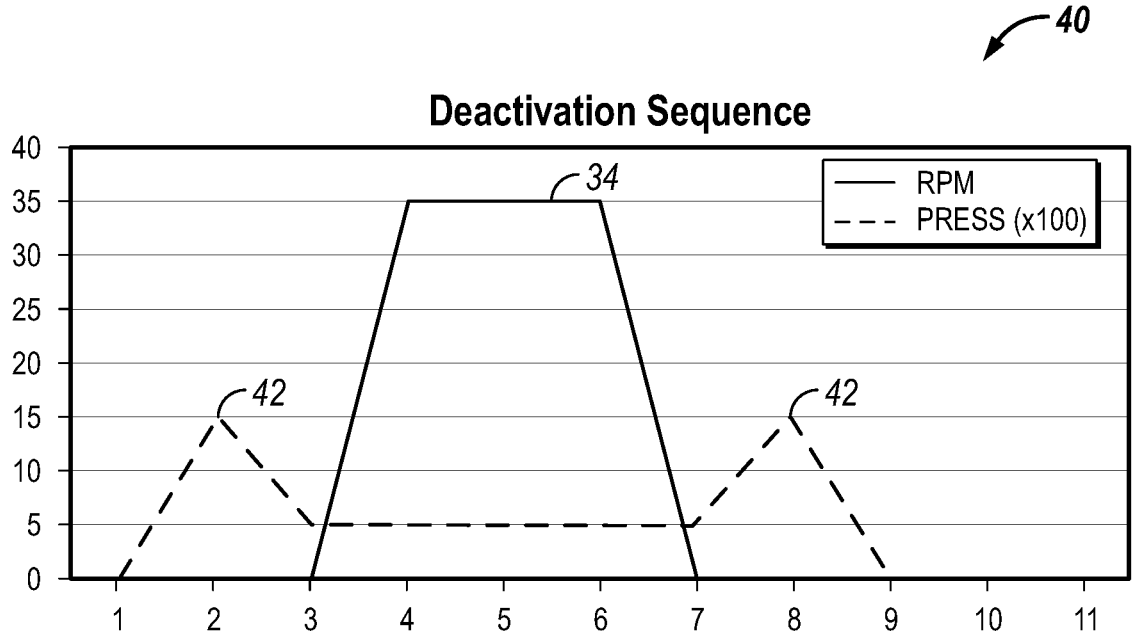
FIG. 3 is a graphical representation of a deactivation sequence 40 according to an example that also combines another activation sequence of rotation and flow.

FIG. 3 is a graphical representation of a deactivation sequence 40 according to an example that also combines another activation sequence of rotation and flow. Generally, a deactivation signal could be substantially the same as the activation signal, such as for use in a toggle on/off (open/closed) control logic for a reamer. In this case, however, the deactivation signal is embodied as a deactivation sequence comprising two pressure rises 42 interspersed with an RPM spike 44 that are distinguishable from the activation sequence of FIG. 2.

Figure 4:
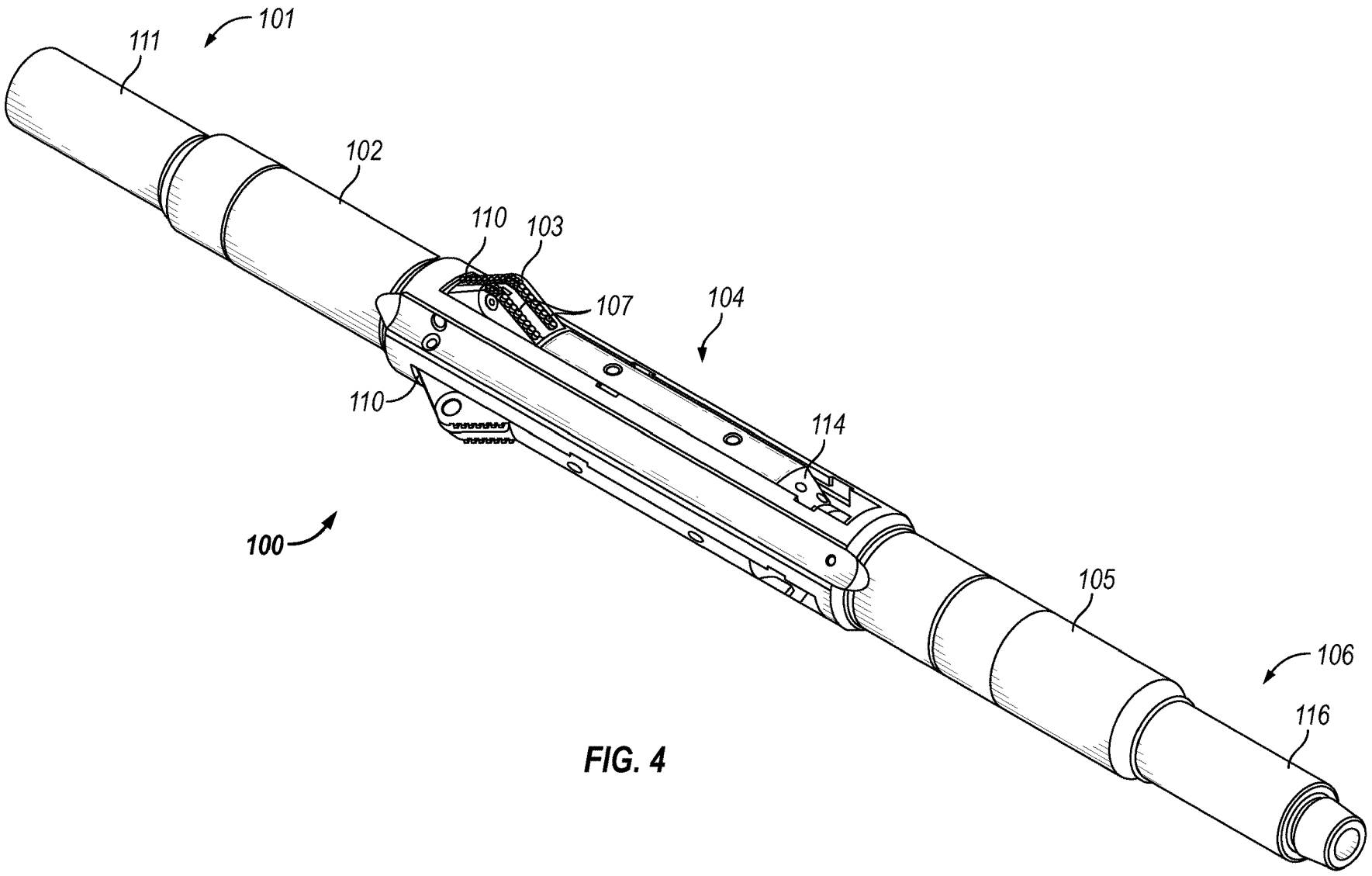
FIG. 4 is a perspective view of the reamer 100 with modular activation and pulse confirmation blocks according to an example configuration.

FIG. 4 is a perspective view of the reamer 100 according to an example configuration having modular activation and pulse confirmation blocks. It is understood that other reamers may be constructed within the scope of this disclosure having any suitable combination of the various features disclosed or ascertainable in view of this disclosure whether or not such features or combinations of features are explicitly disclosed herein. The reamer 100 includes a reamer body 102 that may support various reamer components. Some reamer components (discussed further below) may be housed within a compartment in the reamer body 102 or the bottom sub 116 under a sleeve 105. This sleeve 105 ensures pressure integrity of the components contained inside the blocks, which may include valve members, pistons, batteries, and electronic circuitry.

A top sub 111 and a bottom sub 116 on opposing inlet and outlet ends 101, 106 of the reamer body 102 provide connections (e.g., threaded connections) to couple the reamer 100 within a drill string. An internal through bore (not explicitly shown) passes from the inlet end 101 to the outlet end 106 to allow flow of drilling fluid and other components or materials along the drill string through the reamer 100. Thus, one or more instances of the reamer 100 may be assembled within a drill string along with other drill string components.

The reamer body 102 optionally includes any number of exterior axial pockets for receiving certain reamer components (e.g., reamer arms, electronic control modules, etc.). FIG. 4 specifically shows, for example, reamer arm pockets 110 on the reamer body 102 that contain expandable reamer arms 103. The reamer arms 103 are pivotably secured to the reamer body 102 and may be moved between a retracted position and an extended position in response to activation and deactivation signals. In the retracted position, the reamer arms 103 may be receded at least partially into the reamer arm pockets 110 on the reamer body 102 to help protect the reamer arms 103 as the reamer is tripped in or out of the wellbore prior to or subsequent to a reaming operation. The reamer arms 103 including cutting structures 107 that, when engaged with the wellbore, enlarge the wellbore as the assembly is subsequently rotated through the formation. The reamer arms 103 can be fashioned after a pivoting pin set or a wedge style that rides outward on a track arrangement. A hydraulic reamer arm actuator 104 includes a travel block 114 that transfers axial force to the reamer arms 103 to expand the reamer arms 103 outwardly to engage the surrounding formation.

Figure 5:
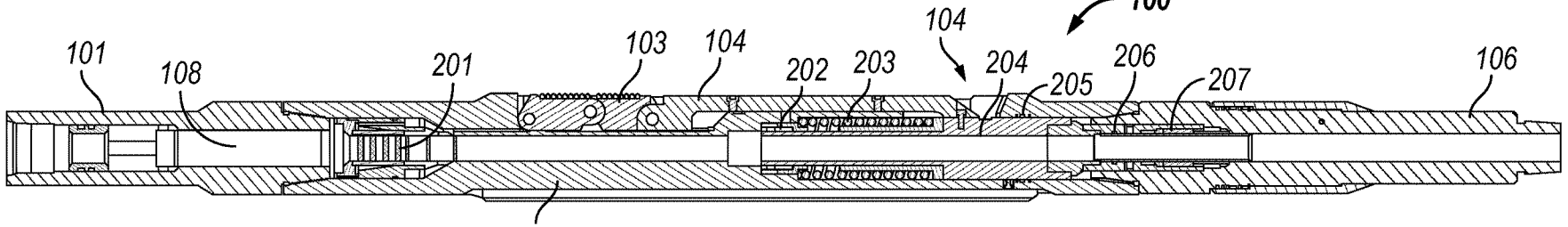
FIG. 5 is a cross-sectional side view of the reamer 100 of FIG. 4 in a deactivated state.

FIG. 5 is a cross-sectional side view of the reamer 100 of FIG. 4 in a deactivated state, with the reamer arm(s) 103 in a retracted position, such as for tripping in or out of a wellbore or otherwise when not reaming. The reamer arm actuator 104 further includes a piston assembly 204 inside the reamer body 102 loosely coupled to the travel blocks 104. At least some of the pressurized drilling fluid flowing through the through bore 108 of the reamer body 102 may be diverted from the reamer body 108 and filtered for use as the working fluid for various reamer components such as the reamer arm actuator 104. The reamer arm actuator 104 further includes seals 205 and 207 that allow the piston assembly 204 to travel axially inside the reamer body 102 as fluid pressure to the piston assembly 204 increases. As the piston assembly 204 responds to the pressure increase in FIG. 5, filtered drilling fluid will fill an activation chamber 208 (FIG. 7) of the hydraulic reamer arm actuator. This, in turn, will compress a biasing member (e.g., spring) 203 of the hydraulic reamer arm actuator 104 to expand the reamer arms 103 toward the extended position. A seal packing 202 provides a stationary seal that maintains seal integrity of the piston assembly 204 inside of the reamer body 102.

Figure 6:
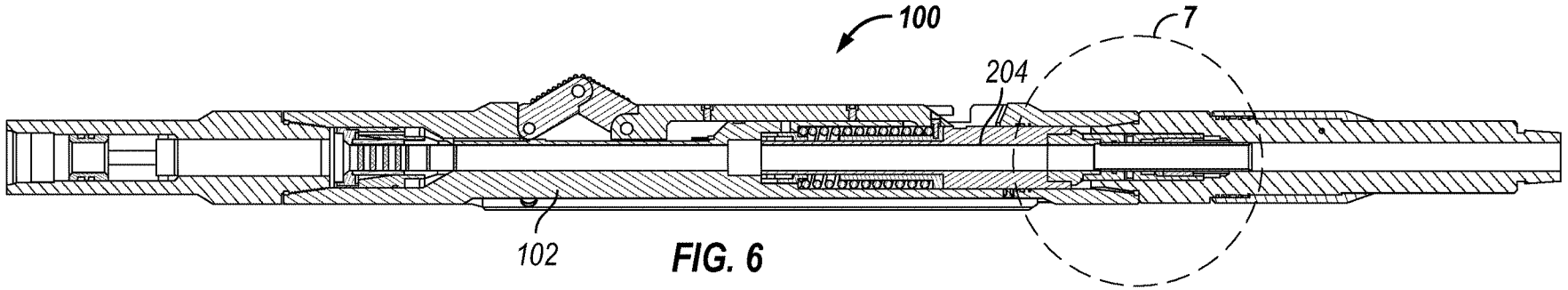
FIG. 6 is a cross-sectional side view of the reamer 100 of FIG. 5 in an activated state.

FIG. 6 is a cross-sectional side view of the reamer 100 of FIG. 5 in an activated state. The reamer arms 103 have been actuated to an extended position, after the piston assembly 204 has responded to the pressure increase as discussed in FIG. 5.

Figure 7:
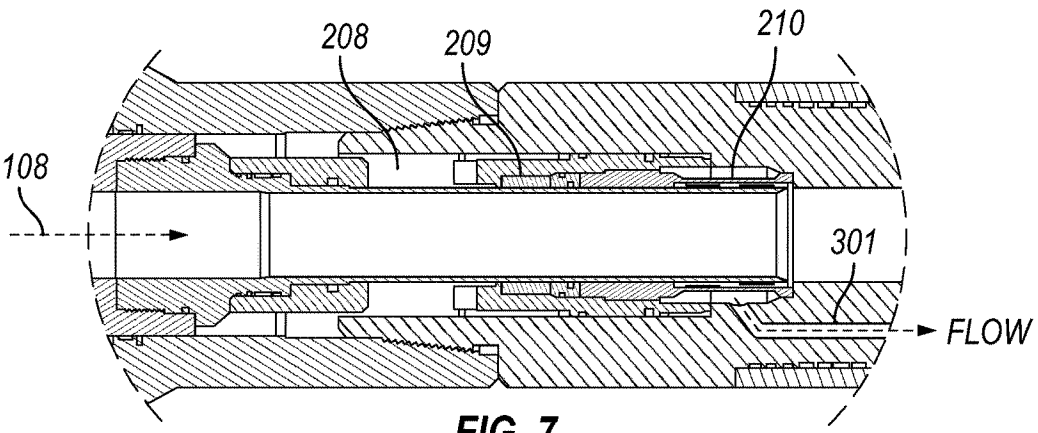
FIG. 7 is an enlarged detail view of the portion encircled at "7" in FIG. 6.

FIG. 7 is an enlarged detail view of the portion encircled at "7" in FIG. 6, showing an activation chamber 208, a filter screen 210, a seal retainer 209, and an inlet port 301 not visible in FIG. 6. The bulk of drilling fluid flowing through a drill string may flow through a through bore 108 from the uphole end 101 to the downhole end 106 of the reamer 100. Some of the drilling fluid may be diverted for use as a working fluid to components of the reamer 100. The bulk drilling fluid may include particulates such as drilling fluid additives, formation cuttings, or other impurities that can migrate into the drilling fluid despite filtering by surface equipment. The filter screen 210 is therefore provided to filter the drilling fluid before it enters one or more inlet port 301 for use as the working fluid to operate the reamer. The filtered drilling fluid may then pass through reamer flow paths in the reamer, such as an activation flow path for activating the reamer arms and a pulse flow path used to generate a confirmation of the activated reamer arms, as will be further discussed below. After actuating the reamer arms or performing another reamer function the diverted drilling fluid ultimately may be exhausted back to the bulk flow of drilling fluid, such as to the annulus about the drill string. Although not explicitly shown, a system could be constructed within the scope of this disclosure to alternatively route flow back into the through bore or drill string downstream.

Figure 8:
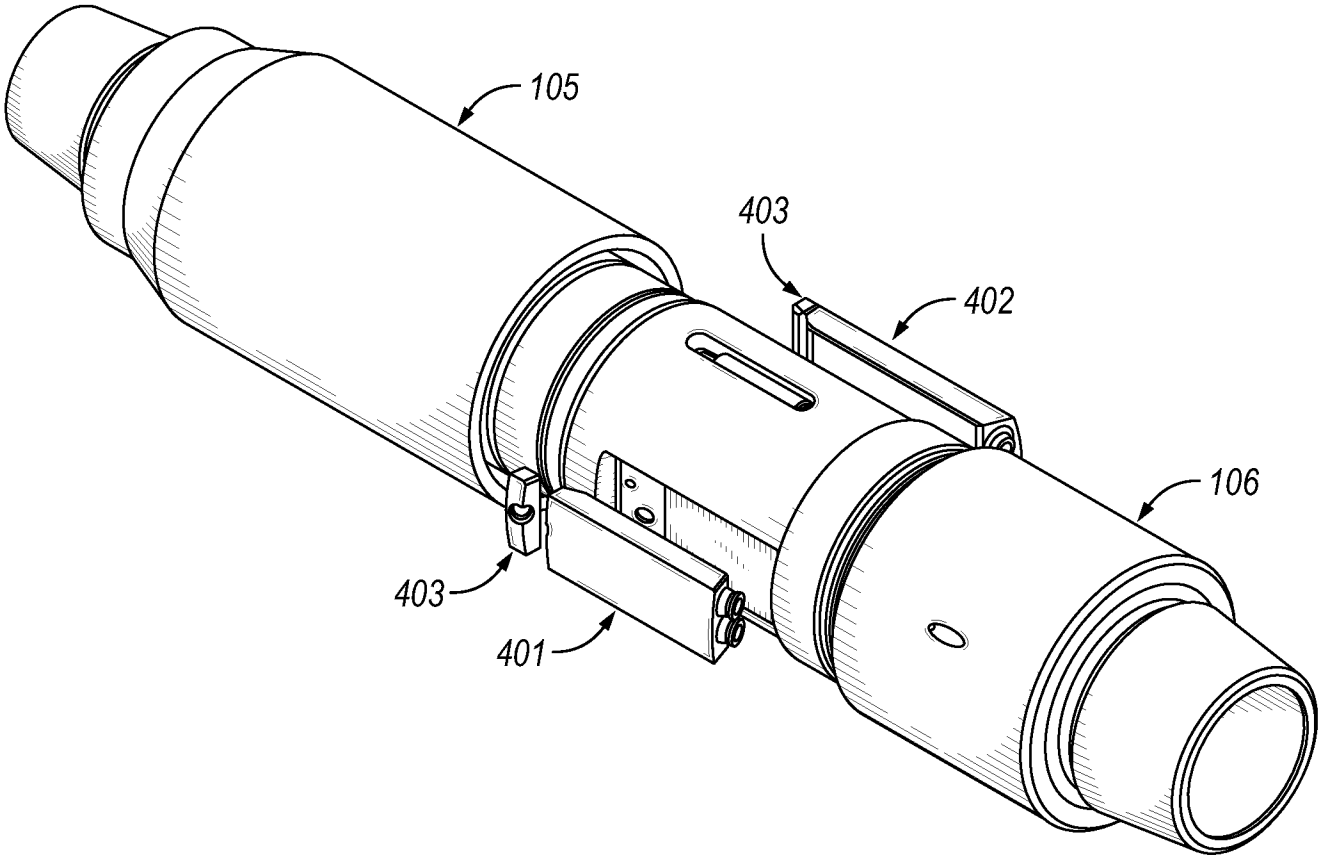
FIG. 8 is a perspective view of the Bottom Sub 116 according to an example configuration having modular activation and pulse confirmation block assemblies.

FIG. 8 is a perspective view of the bottom sub 116 according to an example configuration having modular activation and pulse confirmation block assemblies 401, 402 that define working fluid paths through the reamer body 102. The block assemblies, which may be referred to generally as "blocks," include an activation block 401 used for activating reamer arms and a pulse confirmation block 402 used for confirming the activation of the reamer arms. The activation block 401 and pulse confirmation block 402 are mounted to respective pockets in the outer surface of the bottom sub 106. These blocks 401, 402 may also be secured in position by retaining wedges 403, to ensure a tight, secure fit to the reamer body and minimize shaking or rattling. The sleeve 105 may slide over the blocks 401, 402 to cover and constrain the blocks 401, 402 inside of the reamer body.

Pressurized drilling fluid is used as the working fluid for the activation block 401 and the pulse confirmation block 402. The filtered drilling fluid feeds into the working fluid paths defined by the activation block 401 and pulse confirmation block 402 to perform the various functions. The use of modular block assemblies facilitate manufacturing, including forming the working fluid paths, as well as installing, repairing, and/or replacing the block assemblies. For example, the main structure for the blocks and the flow paths defined therein may be manufactured by additive manufacturing (aka 3D printing) that might be hard to form by other manufacturing methods such as subtractive machining.

Other embodiments may be constructed wherein the working fluid paths are defined by the reamer body or other reamer components without the use of modular block assemblies.

Figure 9:
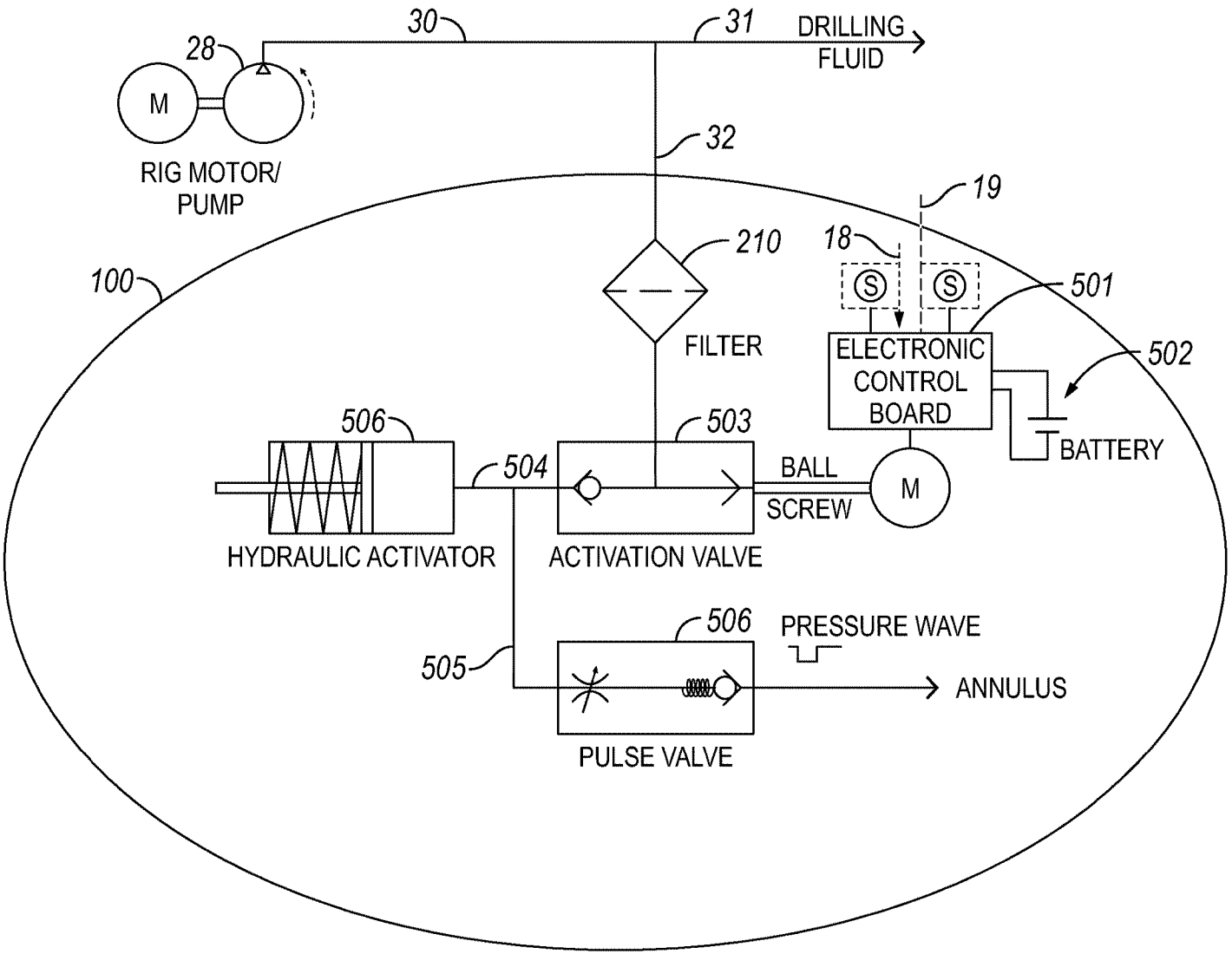
FIG. 9 is a fluid circuit diagram schematically describing the hydraulic operation of the reamer 100 according to one or more embodiments and modes of operation.

FIG. 9 is a fluid circuit diagram schematically describing the hydraulic operation of the reamer 100 according to one or more embodiments and modes of operation. The pump 28 may comprise a rig pump that provides the pressurized flow of drilling fluid 30 for downhole use such as for drilling and reamer operation. The bulk of the drilling fluid may be circulated along a primary flow path 31 through the drill string. The pressurized drilling fluid is therefore available all along the drill string, and may be used as a working fluid within the hydraulic circuit within the reamer 100. Thus, a portion of the drilling fluid is diverted to a secondary flow path 32 for use as the working fluid for the reamer. The drilling fluid along the secondary flow path 32 is filtered by the filter screen 210 as it enters the reamer 100.

A controller 501 is located downhole, which may be inside the reamer 100 or a sub connected thereto. The electronic controller 501 may be powered by a downhole electrical power source, such as an on-board battery 502. The controller 501 may monitor a signal input 19 for the activation signal 18. In some cases, the activation signal 18 may be communicated downhole along a transmission path comprising electrical, electromagnetic, optical, and/or optical pathways. In cases where the activation signal 18 is embodied by an activation sequence, various sensors "S" in communication with the controller 501 may detect components of the activation sequence (e.g., flow and RPM) and the controller 501 may detect the activation sequence by matching the activation sequence with a representation of this activation sequence in memory.

In response to receiving the activation signal 18, the controller 501 initiates activation of the reamer and the generation of a flow pattern detectable uphole to confirm the activation of the reamer. In this example, the controller 501 is coupled to a first valve, referred to as the activation valve 503. The activation valve 503 can be any of a variety of valve types, such as a shuttle valve that the controller 501 may open in response to the activation signal. Opening the activation valve 503 supplies pressure from the drilling fluid along a first reamer fluid path referred to as the activation fluid path 504 to a hydraulic reamer arm actuator to actuate the reamer arms.

The pressurized fluid is supplied in parallel along a second reamer flow path referred to as the pulse flow path 505. Flow along the pulse flow path 505 is used to operate a second valve referred to as the pulse valve 506 and to supply flow through the pulse valve 506 to generate a flow pattern in the well (e.g., in the annulus) to confirm the actuation of the reamer arms. The flow pattern may comprise a pulse, such as a negative fluid pulse, that propagates uphole of the reamer and may be detectable uphole of the reamer, such as at the surface of the wellsite. The features of the fluid circuit in FIG. 9 may be achieved using any of a variety of reamer configurations within the scope of this disclosure, examples of which provided below include use of an activation block and pulse confirmation block.

Confirmation of the reamer activation (or reamer deactivation) may trigger one or more steps, such as to commence (or cease) reaming, or any other step related to reaming, drilling, or other wellbore activities that may or may not involve the use of the drill string. For example, it may be desirable to confirm that the reamer arms are activated before performing a reamer operation, which may involve resuming rotation of the drill string. As another example, it may be desirable to confirm that the reamer arms are deactivated before tripping out of the wellbore.

Figure 10:
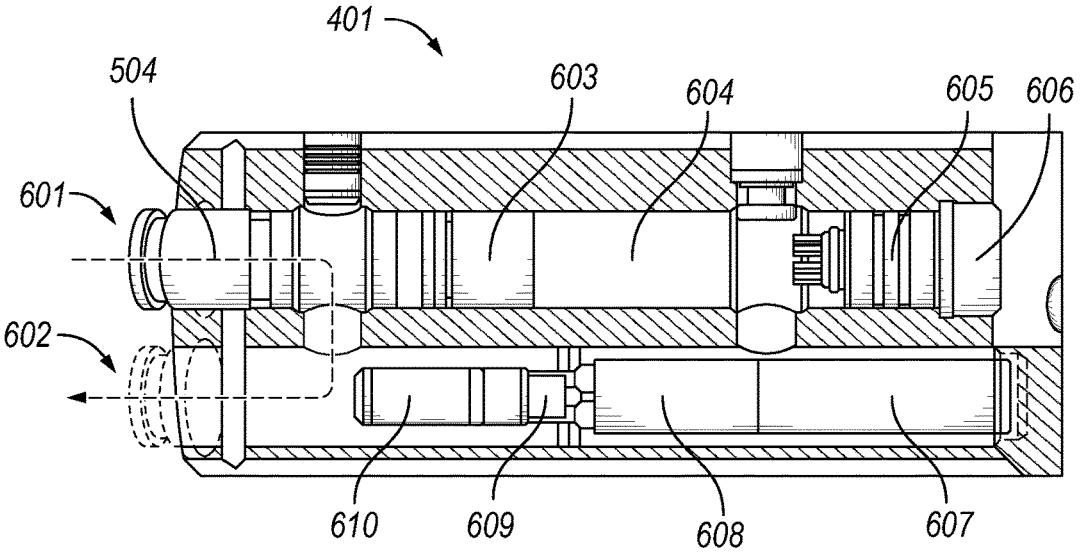
FIG. 10 is a sectional side view of the modular activation block 401 of FIG. 8.

FIG. 10 is a sectional side view of the modular activation block 401 of FIG. 8. The activation block 401 may be in communication with the controller, which is not carried on the activation block 401 in this example. Various components carried on the activation block 401 may include an activation valve comprising a shuttle valve 610 are carried on the activation block 401. The activation block 401 also defines the activation flow path 504 that is fluidically coupled as part of a fluid circuit through the reamer from the through bore of the reamer body to the activation chamber 208 (see, e.g., FIG. 7) and ultimately exhausted to the annulus. The shuttle valve 610 is provided along the activation flow path 504 to open or close flow through the activation flow path 504. Initially, the shuttle valve 610 is in the closed position. The controller 501 includes an electronic control board connected to a motor 607 via a bulkhead connector 605. The motor 607 is coupled to the shuttle valve 610 via a gearbox 608 and ball screw 609 assembly. In response to the activation signal, the controller 501 powers the motor 607 to move the shuttle valve 610 from a closed position to an open position. Opening the activation flow path 504 allows filtered drilling fluid to flow through the activation flow path from an inlet port 601 to an outlet port 602 to drive expansion of the reamer arms. A compensation piston 603 is included as one way to provide pressure equalization to an oil volume 604 to minimize seal wear and friction levels during the shuttle valve transition. The outlet port 602 is fluidically coupled to the hydraulic reamer arm actuator (e.g., to the fill volume 208 of FIG. 7), whereby the pressurized drilling fluid is used to drive reamer arm actuation. The outlet port 602 of the activation flow path 504 is also fluidically coupled to ports on a pulse confirmation block 402 of FIG. 11, both to provide pressure for opening a pulse flow path and for flowing the pressurized fluid along the open pulse flow path.

Figure 11:
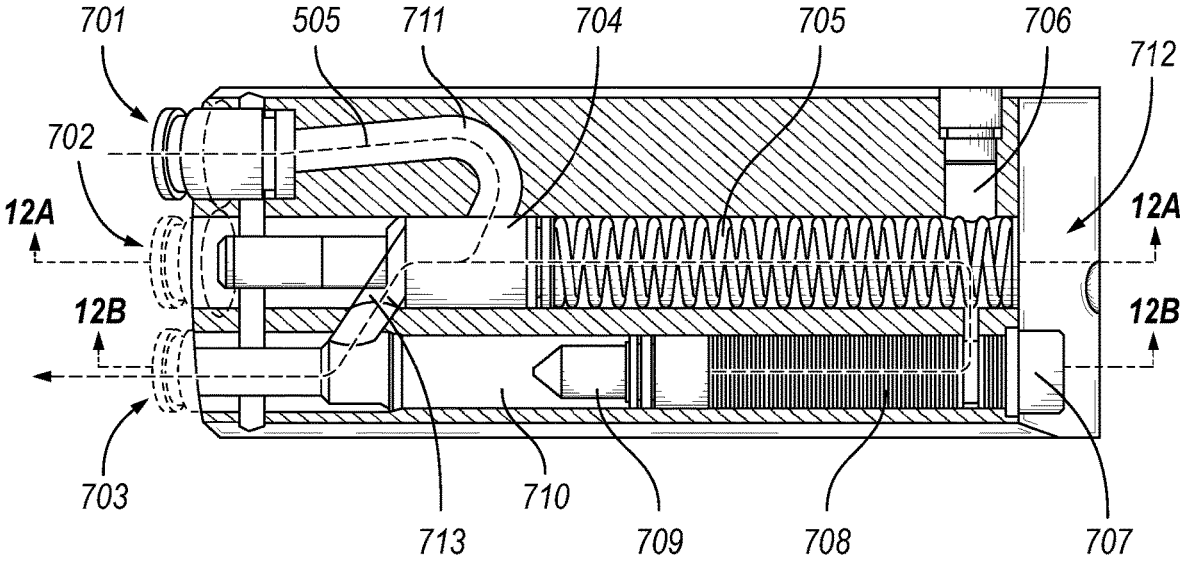
FIG. 11 is a sectional side view of the modular pulse confirmation block 402.

FIG. 11 is a sectional side view of the modular pulse confirmation block 402. The pulse confirmation block 402 defines the pulse flow path 505, which extends at least from an inlet port 701 to an outlet port 703. The outlet port 602 of the activation block (FIG. 10) is fluidically coupled to the inlet port 701 and also to a valve control port 702 in FIG. 11. A second valve comprising a delay piston 704 in this example is operable in response to pressure at the valve control port 702. Thus, pressurized fluid may be used to open flow along the pulse flow path 505 and to supply pressurized fluid to the pulse flow path 505. The delay piston 704 may be biased to a closed position with a biasing member, such as a spring 705, preventing filtered drilling fluid from flowing through a bore 711 and venting to outlet port 703.

A metering assembly, contained in component 707 (e.g., a retainer plug), is used to influence a duration of the flow along the pulse flow path 505. A first piston (the delay piston 704) and a second piston (referred to as the pulse piston 709) are separated by a damping fluid (e.g., oil or other incompressible fluid) in a volume 706 defined along a damping flow path 712. Movement of the delay piston 704 initially opens flow along the pulse flow path 505 and movement of the pulse piston 709 subsequently re-closes the flow along the pulse flow path 505. This movement is damped by the damping fluid to modulate flow along the pulse flow path 505 such as to control how long the pulse flow path 505 is open. The flow of damping fluid along the damping flow path 505 continues until enough oil has transferred to the point when the pulse piston 709 closes off port 703. At this point the internal bore pressure will increase to the previous level completing the negative pulse profile detected on surface.

In operation of the reamer, when the activation block 401 of FIG. 10 is closed, no pressure is supplied to the valve control port 701 and so the pulse flow path 505 remains closed. When the activation block 401 of FIG. 10 is in an open state to actuate the reamer arms, drilling fluid pressure from outlet port 602 acts on the end of the delay piston 704 in FIG. 11. At some threshold, the pressure acting on the delay piston 704 overcomes the pressure at the outlet port 703, the bias of the spring 705, etc., thus urging the delay piston 704 to the right. As the delay piston 704 moves, it acts on the damping fluid in volume 706, which is metered through a bore of a retainer plug 707. The delay piston 704 begins to compress the spring 705 and extend a lower spring 708. During this transition, a bore 711 along the pulse flow path 505 is opened, allowing fluid to flow across the delay piston 704 and out through the outlet port 703. A resulting pressure drop of the internal bore pressure can result in a flow pattern having, such as a fluid pulse having certain expected characteristics so that the flow pattern can be detected uphole of the reamer, such as at the surface of the well site.

Figure 12A:
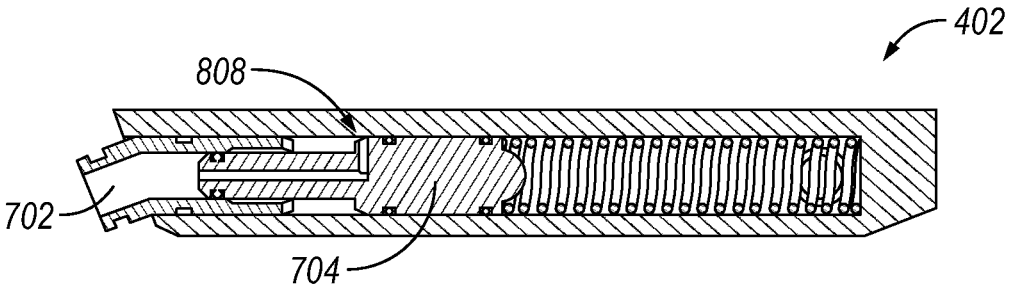
FIG. 12A is a sectional view taken along 12A in FIG. 11, showing an equalization port 808 in the delay piston 704.
Figure 12B:
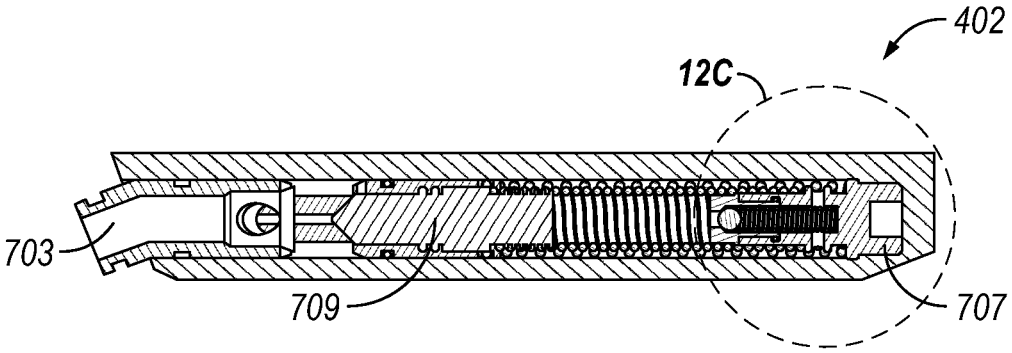
FIG. 12B is a sectional view taken along section line 12B in FIG. 11.
Figure 12C:
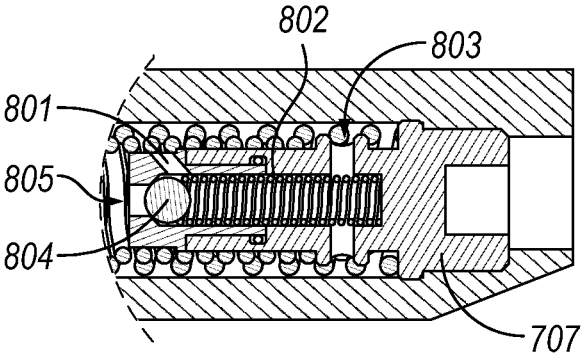
FIG. 12C is an enlarged detail view of the portion encircled in FIG. 12B.

FIGS. 12A-12C are sectional views illustrating further features of the pulse confirmation block assembly 402. FIG. 12A is a sectional view taken along 12A in FIG. 11, showing an equalization port 808 in the delay piston 704. The purpose for this small port is to equalize pressure within the activation chamber 208 (see FIG. 7) while tripping the reamer assembly into the hole. FIG. 12B is a sectional view taken along section line 12B in FIG. 11. FIG. 12C is an enlarged detail view of the portion encircled in FIG. 12B. A retainer plug 707 controls the flow rate of oil from behind the delay piston 704 over to volume acting on pulse piston 709. The retainer plug 707 is sealed to ensure the flow of damping fluid (e.g., oil) is throttled through a restrictor hole 801 when the shuttle valve 610 is open and a pressure differential is present between ports 702 and 703. The direction of the oil flow continues until the pulse piston 709 contacts the inner upset of the port 703. This is when the indicator pulse is terminated. Drilling may continue with the reamer arms in their expanded state until the rig pumps are shut down. When that event occurs, the dual spring bias will reverse the oil flow back to the center bore of block 806. A spring-loaded ball 804 will also be forced off its seat to increase the flow area through bore 805. This will decrease the time required for the delay piston to reset. Once the delay piston is reset, the reverse oil flow stops and the spring-loaded ball is forced back on its seat.

One benefit of this oil return feature is that the pulse confirmation block is reset and a pulse profile will be generated after a pump cycle occurs. This will be a confirmation to the rig personnel that the reamer is active and no deactivation sequence has been recognized.

The timing of and the duration of the negative pulse is determined by various parameters. First the oil viscosity contained in the block influences the delay piston movement. The size of the restrictor hole 803 and the combined spring stiffness also contribute to the timing of the pulse and duration. The axial distance between ports 711 and 713 (FIG. 11) also determines the duration of the pulse. The diameter of the bores in which the pistons travel is also selected to optimize the pulse timing.

The manufacturing of the activation block and the pulse confirmation block raises certain considerations. For example, the block material selected should have the strength to handle internal pressures of up to 20 kpsi and atmospheric pressure between surfaces. The placement of the internal bores 711 and 713 are influential on the desired timing of the indicator pulse. Material erosion is also a consideration for the profile of these internal bores. It is for these reasons that a three-dimensional metallic printing of the block can be desirable to minimize the leak paths and erosion rates while ensuring adequate strength for this application.

Figure 13A:
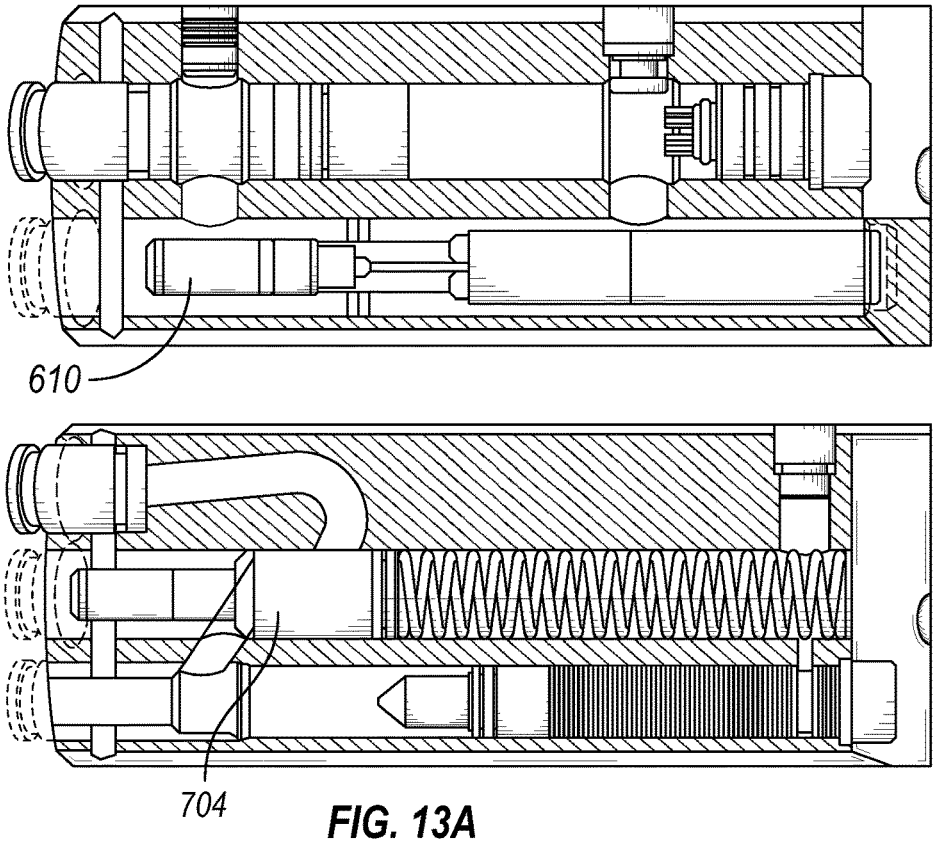
FIG. 13A shows the block assemblies in an initial state, wherein the reamer is inactive and conventional drilling can be carried out.
Figure 13B:
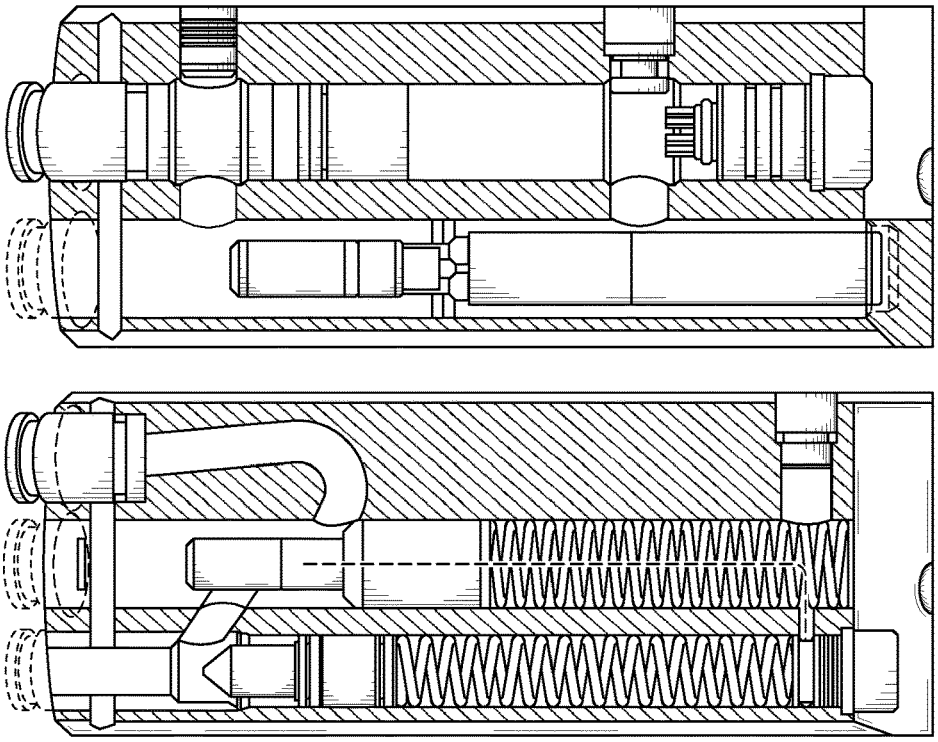
FIG. 13B shows the block assemblies in a second state, with the delay piston in a mid-stroke position.
Figure 13C:
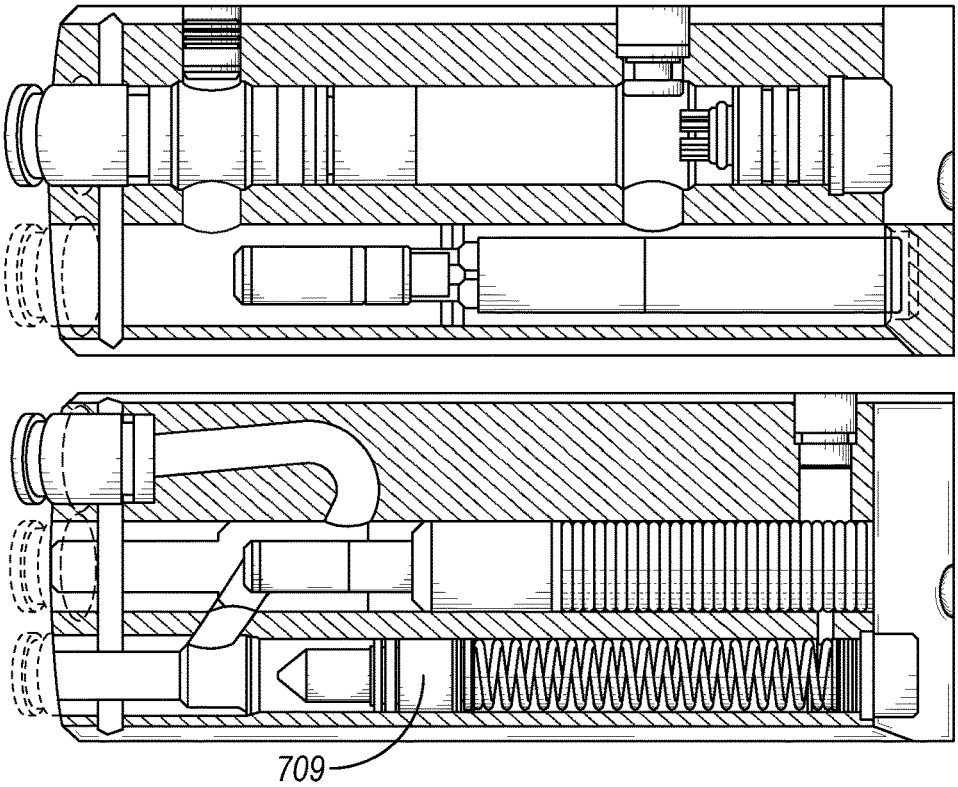
FIG. 13C shows a third state at the instant when the indicator pulse is terminated.
Figure 13D:
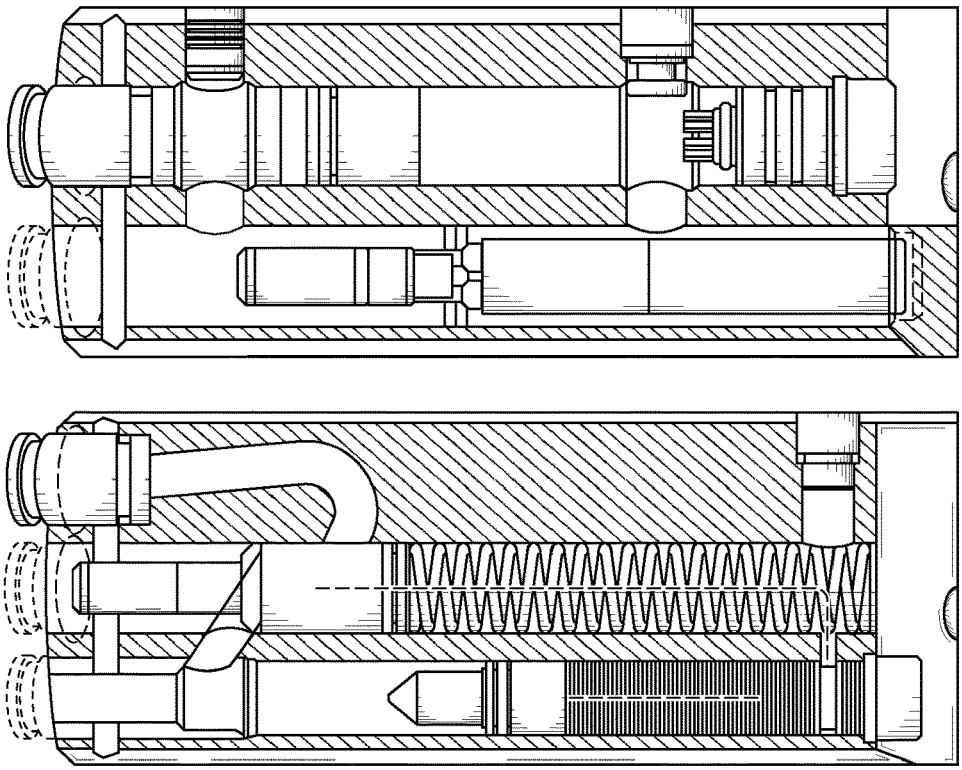
FIG. 13D shows a fourth state in which the delay piston in the reset condition after the rig pumps are stopped and the reverse oil flow has occurred.

FIGS. 13A-13D illustrate the coordinated operation of the activation block and the pulse confirmation block at different states, States 1 to 4, respectively. FIG. 13A (State 1) shows the block assemblies in an initial state. The shuttle valve 610 and the delay piston 704 are in the closed positions. In this state, the reamer is inactive and conventional drilling can be carried out. This state continues until the controller recognizes the activation profile. Once that profile is recognized the shuttle valve is opened as shown in FIG. 13B (State 2). This state is shown with the delay piston in a mid-stroke position. The indicator pulse is occurring in this state. FIG. 13C (State 3) shows the instant that the indicator pulse is terminated. The pulse piston 709 has closed the port 703. The reamer has the arms extended and drilling continues. FIG. 13D (State 4) shows the delay piston in the reset condition after the rig pumps are stopped and the reverse oil flow has occurred.

Figure 14:
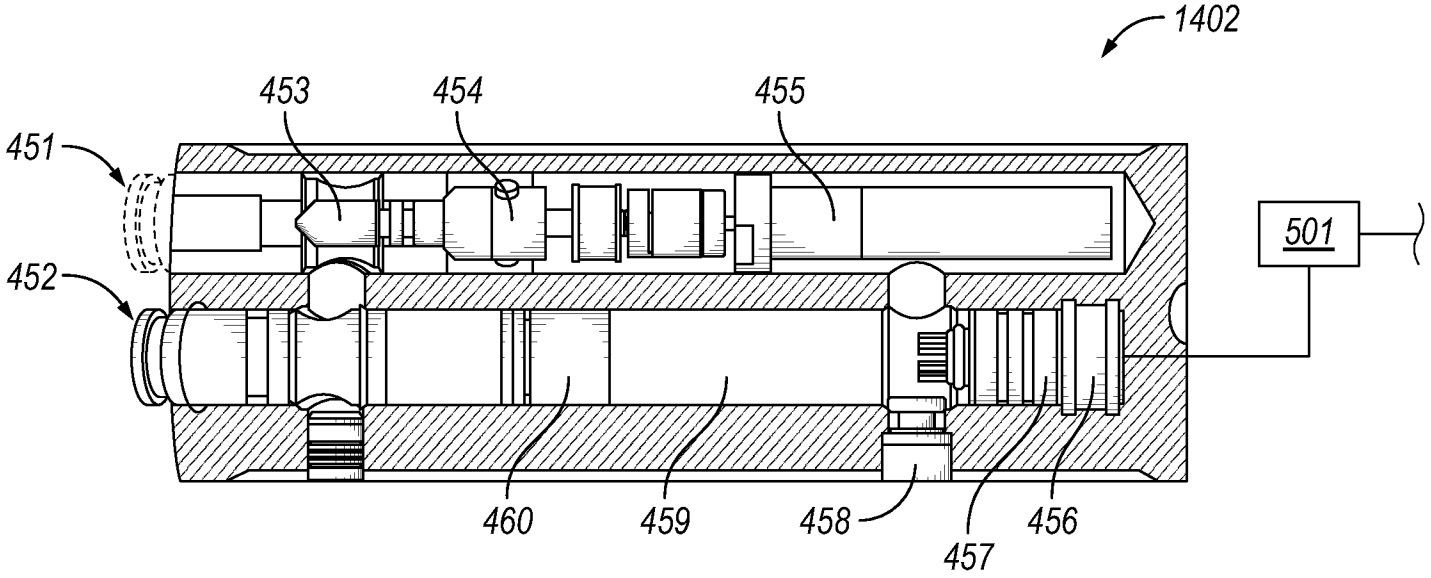
FIG. 14 illustrates a different embodiment for the pulse confirmation block.

FIG. 14 is a sectional side view of a different embodiment for the pulse confirmation block 1402. When this embodiment is utilized, the controller 501 is connected to both the activation block (e.g., as shown in FIG. 9) and to this alternative embodiment of the pulse confirmation block 1402. The controller 501 may include a control board wired to the motor/gearbox 455 via a bulkhead connector 457. The programming of the controller determines when the reamer is active. At preprogrammed events a pulse sequence is generated to provide an indication on surface that the reamer is active. Initially the shuttle valve 453, is in the closed position. When the motor that is coupled to a gearbox and ball screw 454 assembly is activated, the shuttle valve is moved from a closed position to an open position. This allows the filtered drilling fluid to enter port 452 and exit port 451 to create a momentary pressure decrease. After a short period of time, the motor is repowered to close the shuttle valve. The internal pipe pressure from the drill string then rises back to the initial level. This pulse signature can be a single pulse or a series of pulses. The timing and duration of these negative pulses is controlled by the controller. The compensation piston 460 provides a method of pressure equalization to the oil volume 459 to minimize seal wear and friction levels during the shuttle valve transition. In this scenario, the ports between the activation and pulse confirmation blocks do not have to be connected.

Accordingly, the present disclosure includes a multi-activation reamer and method that allow for reamer activation from the surface of a wellsite or even from a remote location, using a reamer activation signal communicated downhole in the form of an activation sequence of flow through the drill string and/or rotation of the drill string that is detectable downhole, such as a combination of drill string pressure and rotation, that are sensed downhole and interpreted by an electronic controller on the reamer body. Aspects of this disclosure may be embodied in a method, apparatus (e.g., a remotely-actuatable reamer), drilling system, and so forth, and may include any of the various features disclosed herein, including one or more of the following statements.

Statement 1. A method, comprising: generating a reamer activation signal at a well site having a reamer in a drill string in a well; receiving the reamer activation signal downhole; initiating a flow of a drilling fluid along an activation flow path in the reamer in response to the reamer activation signal to hydraulically actuate one or more reamer arms of the reamer; initiating a flow of the drilling fluid along a pulse flow path in the reamer and using the flow along the pulse flow path to generate a flow pattern in the well; and detecting the flow pattern uphole of the reamer to confirm the actuation of the reamer arms.

Statement 2. The method of statement 1, wherein generating the reamer activation signal comprises performing a predetermined sequence of one or both of flow through the drill string and rotation of the drill string, and wherein receiving the reamer activation signal downhole comprises electronically detecting the predetermined sequence.

Statement 3. The method of statement 2, wherein initiating the flow of the drilling fluid along the activation flow path comprises electronically opening a first valve along the activation flow path in response to electronically detecting the predetermined sequence.

Statement 4. The method of statement 1, wherein actuating the one or more reamer arms comprises using a pressure along the activation flow path to drive a hydraulic reamer arm actuator coupled to the reamer arms.

Statement 5. The method of statement 4, wherein initiating the flow of the drilling fluid along the pulse flow path comprises using the pressure along the activation flow path to also open a second valve along the pulse flow path.

Statement 6. The method of statement 1, wherein generating the flow pattern comprises generating a pressure pulse by controlling the flow along the pulse flow path between the drill string and an annulus about the drill string, the pressure pulse propagating up the well from the reamer.

Statement 7. The method of statement 6, wherein generating the pressure pulse by controlling the flow along the pulse flow path further comprises using a pressure along the first flow path to drive a metering assembly to temporarily open and then close the flow along the pulse flow path.

Statement 8. The method of statement 7, wherein driving the metering assembly to open and then close the flow along the pulse flow path comprises moving a first piston and a second piston separated by a damping fluid along a damping flow path, wherein movement of the first piston initially opens the flow along the second flow path and movement of the second piston subsequently closes the flow along the second flow path.

Statement 9. The method of statement 8, further comprising: subsequently reducing the pressure along the first flow path; and biasing the first and second pistons back toward their previous positions along the damping flow path.

Statement 10. A method of reaming a wellbore, comprising: lowering a reamer into the wellbore to a selected reaming location; generating a reamer activation signal to open an activation flow path; flowing pressurized drilling fluid along the activation flow path, when open, and using a pressure along the activation flow path to hydraulically extend one or more reamer arms of the reamer; opening flow of the pressurized drilling fluid along a pulse flow path to generate a flow pattern in the well; detecting the flow pattern in the well uphole of the reamer to confirm the extension of the reamer arms; and rotating the reamer with the reamer arms extended against the wellbore while advancing the reamer axially in the wellbore.

Statement 11. The method of statement 10, wherein opening flow of the pressurized drilling fluid along a pulse flow path comprises using the pressure along the activation flow path to open the flow of the pressurized drilling fluid along the pulse flow path.

Statement 12. The method of statement 10, wherein generating the flow pattern in the well comprises moving a first piston and a second piston separated by a damping fluid along a damping flow path, wherein movement of the first piston initially opens the flow along the second flow path and movement of the second piston subsequently closes the flow along the second flow path.

Statement 13. The method of statement 10, further comprising: at least reducing the flow of drilling fluid from a drilling fluid pump to reduce the flow of pressurized drilling fluid along the activation flow path; closing the activation and pulse flow paths; and retracting the one or more reamer arms in response to closing the activation flow path.

Statement 14. A remotely-actuatable reamer, comprising: a reamer body positionable in a well including opposing inlet and outlet ends for connection within a drill string and a through bore extending from the inlet end to the outlet end; one or more reamer arms pivotably secured to the reamer body; a hydraulic reamer arm actuator coupled to the one or more reamer arms; an activation block within the reamer body defining an activation flow path fluidically coupling the through bore of the reamer body with the hydraulic reamer arm actuator, the activation block including a first valve along the activation flow path operable in response to a reamer activation signal; and a pulse confirmation block within the reamer body defining a pulse flow path fluidically coupling the through bore of the reamer body with an annulus exhaust port, the pulse confirmation block including a second valve along the pulse flow path operable in response to the reamer activation signal to generate a flow pattern comprising a detectable fluid pulse.

Statement 15. The reamer of statement 14, further comprising: an electronic controller in the reamer body coupled to the first valve in the activation block, the electronic control module comprising one or more electronic sensors and control logic responsive to the activation signal to open the first valve in response to the activation signal.

Statement 16. The reamer of statement 15, wherein the electronic controller is modular and is removably secured within the reamer body.

Statement 17. The reamer of statement 15, wherein the reamer activation signal comprises a predetermined sequence of flow through the reamer and/or rotation detectable at the reamer.

Statement 18. The reamer of statement 14, wherein the pulse confirmation block further comprises: a first piston moveable within the activation block to alternately open and close the pulse flow path; a second piston moveable within the pulse confirmation block to alternately open and close the pulse flow path; a damping fluid along a damping flow path between the first piston and the second piston, whereby pressurized drilling fluid in the activation flow path moves the first piston, second piston, and damping fluid to open the pulse flow path with the first piston and to subsequently close the pulse flow path with the second piston.

Statement 19. The reamer of statement 18, wherein the first and second pistons are biased to close the pulse flow path at the first piston and open the pulse flow path at the second piston when pressure in the activation flow path is reduced.

Statement 20. The reamer of statement 14, wherein one or more of the activation block and pulse confirmation block are modular and are removably secured within the reamer body.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method, comprising:

generating a reamer activation signal at a well site having a reamer in a drill string in a well;

receiving the reamer activation signal downhole;

opening an activation valve in response to the reamer activation signal, wherein the activation valve is disposed along a secondary flow path between a pulse valve and a primary flow path of drilling fluid;

initiating a flow of a drilling fluid along an activation flow path in the reamer in response to the activation valve opening, wherein the activation flow path is fluidly connected to the activation valve, and wherein the flow of drilling fluid along the activation flow path is configured to hydraulically actuate one or more reamer arms of the reamer;

initiating a flow of the drilling fluid along a pulse flow path in the reamer in response to the activation valve opening, wherein the pulse flow path fluidly connects to the activation valve to the pulse valve, and wherein the pulse valve uses the flow along the pulse flow path to generate a flow pattern in the well; and detecting the flow pattern uphole of the reamer to confirm the actuation of the reamer arms.

2. The method of claim 1, wherein generating the reamer activation signal comprises performing a predetermined sequence of one or both of flow through the drill string and rotation of the drill string, and wherein receiving the reamer activation signal downhole comprises electronically detecting the predetermined sequence.

3. The method of claim 2, wherein the activation valve is electronically opened in response to electronically detecting the predetermined sequence.

4. The method of claim 1, wherein actuating the one or more reamer arms comprises using a pressure along the activation flow path to drive a hydraulic reamer arm actuator coupled to the reamer arms.

5. The method of claim 1, wherein the pulse valve is configured to open in response to pressure from the flow of the drilling fluid along the pulse flow path.

6. The method of claim 1, wherein generating the flow pattern comprises generating a pressure pulse by controlling the flow along the pulse flow path between the drill string and an annulus about the drill string, the pressure pulse propagating up the well from the reamer.

7. The method of claim 6, wherein generating the pressure pulse by controlling the flow along the pulse flow path further comprises using a pressure along the activation flow path to drive a metering assembly to temporarily open and then close the flow along the pulse flow path.

8. The method of claim 7, wherein driving the metering assembly to open and then close the flow along the pulse flow path comprises moving a first piston and a second piston separated by a damping fluid along a damping flow path, wherein movement of the first piston initially opens the flow along the pulse flow path and movement of the second piston subsequently closes the flow along the pulse flow path.

9. The method of claim 8, further comprising:

subsequently reducing the pressure along the activation flow path; and biasing the first and second pistons back toward their previous positions along the damping flow path.

10. A method of reaming a wellbore, comprising:

lowering a reamer into the wellbore to a selected reaming location;

generating a reamer activation signal to open an activation flow path;

opening an activation valve in response to the reamer activation signal, wherein the activation valve is disposed along a secondary flow path between a pulse valve and a primary flow path of drilling fluid;

flowing pressurized drilling fluid along the activation flow path in response to the activation valve opening, wherein the activation flow path is fluidly connected to the activation valve, and using a pressure along the activation flow path to hydraulically extend one or more reamer arms of the reamer;

flowing the pressurized drilling fluid along a pulse flow path in response to the activation valve opening, wherein the pulse flow path fluidly connects to the activation valve to the pulse valve, and wherein the pulse valve uses the flow of the pressurized drilling fluid along a pulse flow path to generate a flow pattern in the well;

detecting the flow pattern in the well uphole of the reamer to confirm the extension of the reamer arms; and rotating the reamer with the reamer arms extended against the wellbore while advancing the reamer axially in the wellbore.

11. The method of claim 10, wherein generating the flow pattern in the well comprises moving a first piston and a second piston separated by a damping fluid along a damping flow path, wherein movement of the first piston initially opens the flow along the pulse flow path and movement of the second piston subsequently closes the flow along the pulse flow path.

12. The method of claim 10, further comprising:

at least reducing the flow of drilling fluid from a drilling fluid pump to reduce the flow of pressurized drilling fluid along the activation flow path;

closing the activation flow path and the pulse flow paths via closing the activation valve; and retracting the one or more reamer arms in response to closing the activation flow path.

13. A remotely-actuatable reamer, comprising:

a reamer body including opposing inlet and outlet ends for connection within a drill string and a through bore extending from the inlet end to the outlet end, wherein the through bore forms a primary flow path for drilling fluid passing through the reamer body;

one or more reamer arms pivotably secured to the reamer body;

a hydraulic reamer arm actuator coupled to the one or more reamer arms;

an activation block within the reamer body defining an activation flow path that fluidically couples the primary flow path with the hydraulic reamer arm actuator, the activation block including an activation valve disposed along the activation flow path between the primary flow path and the hydraulic reamer arm actuator, and wherein the activation valve is operable in response to a reamer activation signal; and a pulse confirmation block within the reamer body defining a pulse flow path that fluidically couples the primary flow path with an annulus exhaust port, wherein the pulse confirmation block includes a pulse valve disposed along the pulse flow path, wherein the activation valve is disposed between the pulse valve and the primary flow path, and wherein the pulse valve is operable in response to the reamer activation signal to generate a flow pattern comprising a detectable fluid pulse.

14. The reamer of claim 13, further comprising:

an electronic controller in the reamer body coupled to the activation valve in the activation block, the electronic control module comprising one or more electronic sensors and control logic responsive to the activation signal to open the activation valve in response to the activation signal.

15. The reamer of claim 14, wherein the electronic controller is modular and is removably secured within the reamer body.

16. The reamer of claim 14, wherein the reamer activation signal comprises a predetermined sequence of flow through the reamer and/or rotation detectable at the reamer.

17. The reamer of claim 13, wherein the pulse confirmation block further comprises:

a first piston moveable within the activation block to alternately open and close the pulse flow path;

a second piston moveable within the pulse confirmation block to alternately open and close the pulse flow path;

a damping fluid along a damping flow path between the first piston and the second piston, whereby pressurized drilling fluid in the activation flow path moves the first piston, second piston, and damping fluid to open the pulse flow path with the first piston and to subsequently close the pulse flow path with the second piston.

18. The reamer of claim 17, wherein the first and second pistons are biased to close the pulse flow path at the first piston and open the pulse flow path at the second piston when pressure in the activation flow path is reduced.

19. The reamer of claim 13, wherein one or more of the activation block and pulse confirmation block are modular and are removably secured within the reamer body.

* * * * *